US009797277B2

(12) United States Patent
Chung et al.

(10) Patent No.: US 9,797,277 B2
(45) Date of Patent: Oct. 24, 2017

(54) CAMSHAFT PHASER

(71) Applicant: Schaeffler Technologies AG & Co. KG, Herzogenaurach (DE)

(72) Inventors: Inhwa Chung, Lasalle (CA); Kevin Poole, Northville, MI (US); Nicholas Periat, Bloomfield Hills, MI (US); Jon Petersen, Royal Oak, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 98 days.

(21) Appl. No.: 15/041,249

(22) Filed: Feb. 11, 2016

(65) Prior Publication Data

US 2016/0245130 A1 Aug. 25, 2016

Related U.S. Application Data

(60) Provisional application No. 62/118,736, filed on Feb. 20, 2015.

(51) Int. Cl.

| | |
|---|---|
| ***F01L 1/34*** | (2006.01) |
| ***F01L 1/344*** | (2006.01) |
| ***F01L 1/047*** | (2006.01) |

(52) U.S. Cl.

CPC ..... *F01L 1/3442* (2013.01); *F01L 1/047* (2013.01); *F01L 2001/0473* (2013.01); *F01L 2001/3444* (2013.01); *F01L 2001/34433* (2013.01)

(58) Field of Classification Search

CPC .. F01L 1/047; F01L 1/3442; F01L 2001/0473

(Continued)

(56) References Cited

U.S. PATENT DOCUMENTS 6,805,080 B2 10/2004 Golovatai-Schmidt et al.
8,051,818 B2 * 11/2011 Myers ..... F01L 1/3442 123/90.17

(Continued)

FOREIGN PATENT DOCUMENTS

| | | | |
|---|---|---|---|
| DE | 102006024793 | A1 | 11/2007 |
| DE | 102009041873 | A1 | 4/2010 |
| EP | 2527607 | B1 | 11/2012 |

OTHER PUBLICATIONS

International Search Report and Opinion for PCT/US2016/017552; 10 pgs; dated May 25, 2016 by Korean Intellectual Property Office.

*Primary Examiner* — Ching Chang
(74) *Attorney, Agent, or Firm* — Antun M. Peakovic

(57) ABSTRACT

A camshaft phaser, including: an inner rotor with radially outwardly extending vanes which is connected to the inner camshaft; a stator having radially inwardly directed projections which contact the outer surface of the rotor and form working spaces into which the vanes extend, the vanes divide the working spaces into first and second sets of pressure chambers which can be pressurized with a hydraulic medium in order to rotate the rotor in an advancing or retarding direction; a front cover connected to a front side of the assembly defining a front side of the pressure chambers; and a rear cover connected to the rear side of the assembly defining a rear side of the pressure chambers, having first and second protrusions directed toward and meshed with complementary first and second indentations on an outer camshaft.

20 Claims, 5 Drawing Sheets

(58) Field of Classification Search
USPC ..... 123/90.15, 90.17
See application file for complete search history.

(56) References Cited

U.S. PATENT DOCUMENTS

| | | | |
|---|---|---|---|
| 8,122,863 | B2 | 2/2012 | Myers |
| 2010/0089350 | A1 | 4/2010 | Myers |
| 2010/0089353 | A1 | 4/2010 | Myers et al. |
| 2011/0220047 | A1 | 9/2011 | Moon et al. |
| 2013/0025403 | A1 | 1/2013 | Wigsten |
| 2014/0083385 | A1 | 3/2014 | Fischer et al. |
| 2014/0158074 | A1 | 6/2014 | Wigsten et al. |

* cited by examiner

CAMSHAFT PHASER

TECHNICAL FIELD

The present disclosure relates to a camshaft phaser or adjuster for the inner camshaft of a concentric camshaft assembly, and in particular to a camshaft phaser or adjuster for adjusting the relative rotational angle position of an inner camshaft of a concentric camshaft assembly relative to the phase position of the outer camshaft and the crankshaft of an internal combustion engine.

BACKGROUND

Camshaft phasers that operate according to the vane-cell principle for use on single camshafts are known. These are described in publications by the assignee of the present invention, including U.S. Pat. No. 6,805,080, which is incorporated herein by reference as if fully set forth. These work well in connection with DOHC engines where all the intake or exhaust cam lobes are located on separately located intake and exhaust camshafts.

It has also been known to use camshaft phasers in connection with concentric camshaft assemblies for controlling the phase position of the inner camshaft, the outer camshaft or both. One such arrangement is described in DE 10 2006 024 793 A1. This publication discloses a dual phasing system for a concentric camshaft assembly which includes two camshaft phasers which are located at the front of an engine that are axially spaced adjacent to one another. These two camshaft phasers allow independent control of the rotation angle of the outer and inner co-axial camshafts relative to the crankshaft in order to allow separate adjustment of the timing of the intake and the exhaust valves of the internal combustion engine. However, this arrangement provides additional complexity which is often not required to obtain many of the benefits of adjusting either the inner or the outer camshafts of a concentric camshaft assembly without the need for adjusting both.

It would be desirable to provide a camshaft phaser for a concentric camshaft assembly that allows for phasing of either the intake or exhaust lobes of a camshaft in which the drive load from the timing chain or belt extending from the crankshaft to the timing gear or timing belt pulley of the concentric camshaft arrangement is transmitted to the outer shaft of the concentric camshaft.

SUMMARY

According to aspects illustrated herein, there is provided a camshaft phaser, including:

an inner rotor with radially outwardly extending vanes which is connected to the inner camshaft; a stator having radially inwardly directed projections which contact the outer surface of the rotor and form working spaces into which the vanes extend, the vanes divide the working spaces into first and second sets of pressure chambers which can be pressurized with a hydraulic medium in order to rotate the rotor in an advancing or retarding direction; a front cover connected to a front side of the assembly defining a front side of the pressure chambers; and a rear cover connected to the rear side of the assembly defining a rear side of the pressure chambers, having first and second protrusions directed toward and meshing with complementary first and second indentations on an outer camshaft.

According to further aspects illustrated herein, the first and second protrusions are different widths. According to yet further aspects illustrated herein, the first, second and third protrusions are separated by different circumferential distances and mesh with first, second and third indentations in an outer camshaft.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
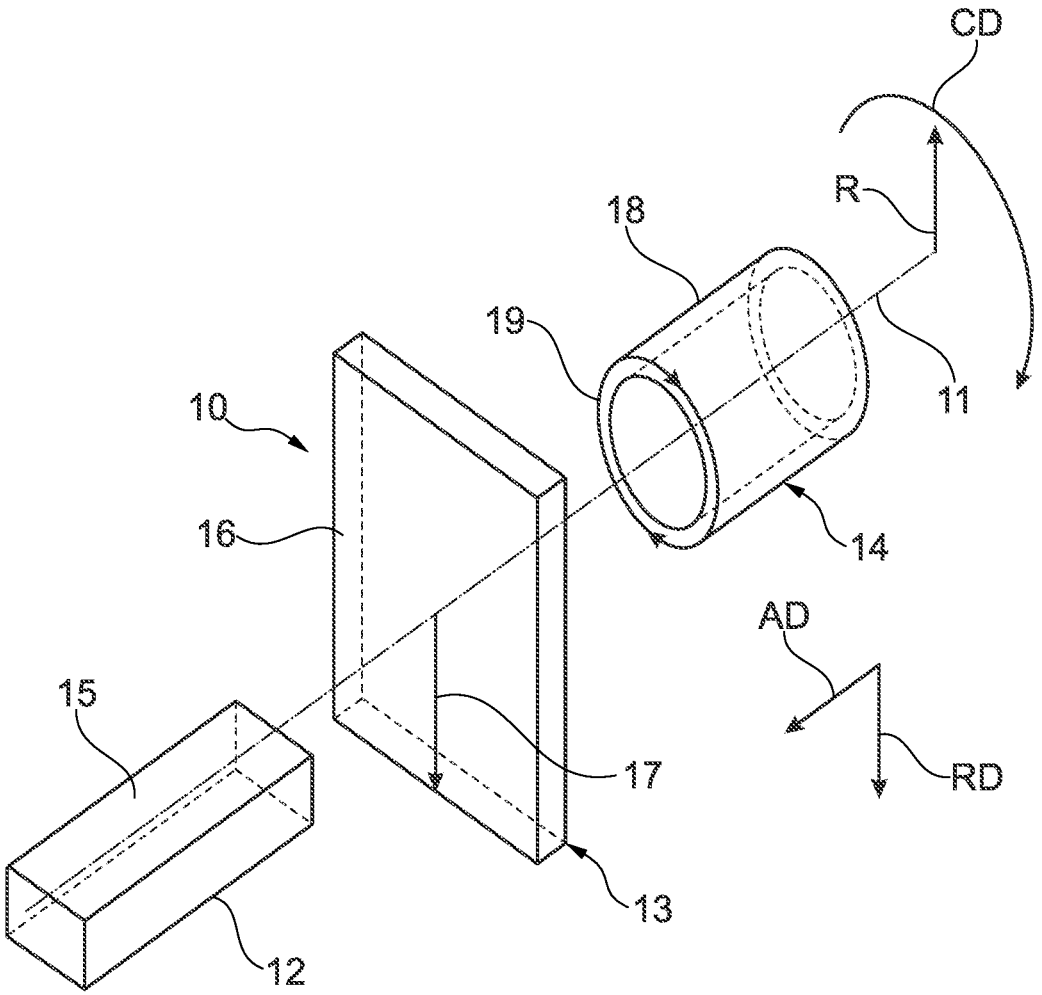
FIG. 1 is a perspective view of a cylindrical coordinate system demonstrating spatial terminology used in the present application.

FIG. 1 is a perspective view of cylindrical coordinate system 10 demonstrating spatial terminology used in the present application. The present application is at least partially described within the context of a cylindrical coordinate system. System 10 includes longitudinal axis 11, used as the reference for the directional and spatial terms that follow. Axial direction AD is parallel to axis 11. Radial direction RD is orthogonal to axis 11. Circumferential direction CD is defined by an endpoint of radius R (orthogonal to axis 11) rotated about axis 11.

To clarify the spatial terminology, objects 12, 13, and 14 are used. An axial surface, such as surface 15 of object 12, is formed by a plane co-planar with axis 11. Axis 11 passes through planar surface 15; however any planar surface co-planar with axis 11 is an axial surface. A radial surface, such as surface 16 of object 13, is formed by a plane orthogonal to axis 11 and co-planar with a radius, for example, radius 17. Radius 17 passes through planar surface 16; however any planar surface co-planar with radius 17 is a radial surface. Surface 18 of object 14 forms a circumferential, or cylindrical, surface. For example, circumference 19 passes through surface 18. As a further example, axial movement is parallel to axis 11, radial movement is orthogonal to axis 11, and circumferential movement is parallel to circumference 19. Rotational movement is with respect to axis 11. The adverbs "axially," "radially," and "circumferentially" refer to orientations parallel to axis 11, radius 17, and circumference 19, respectively. For example, an axially disposed surface or edge extends in direction AD, a radially disposed surface or edge extends in direction R, and a circumferentially disposed surface or edge extends in direction CD.

Figure 2:
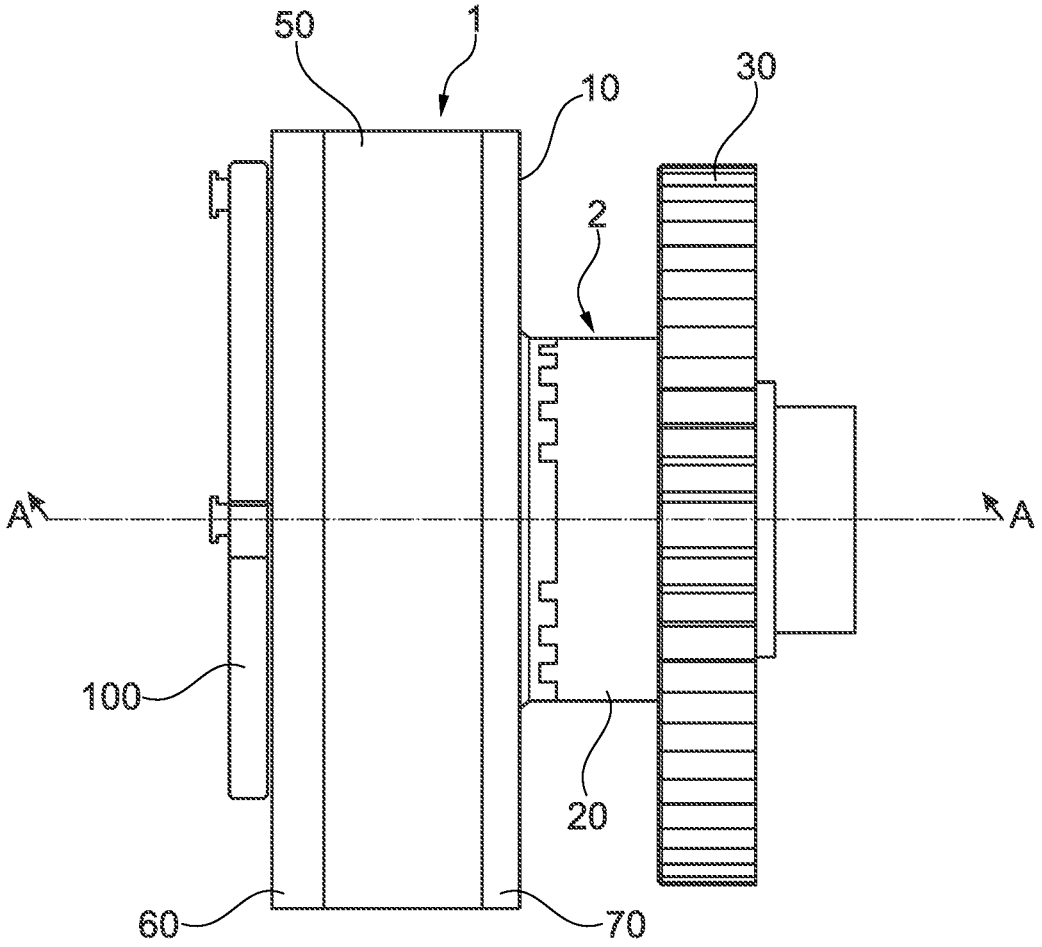
FIG. 2 is a side view of a camshaft phaser and concentric camshaft according to one example embodiment.
Figure 3:
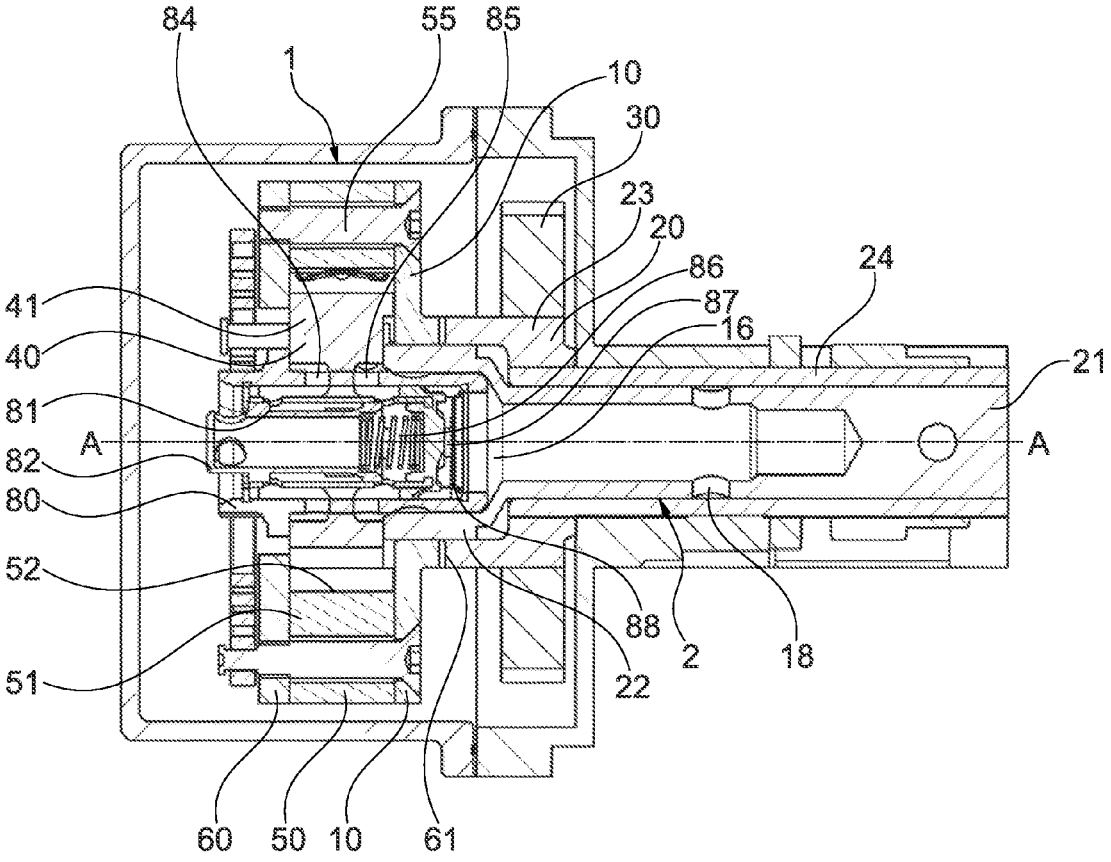
FIG. 3 is a cross-sectional view of the camshaft phaser and concentric camshaft of FIG. 2 taken along line A-A.
Figure 4:
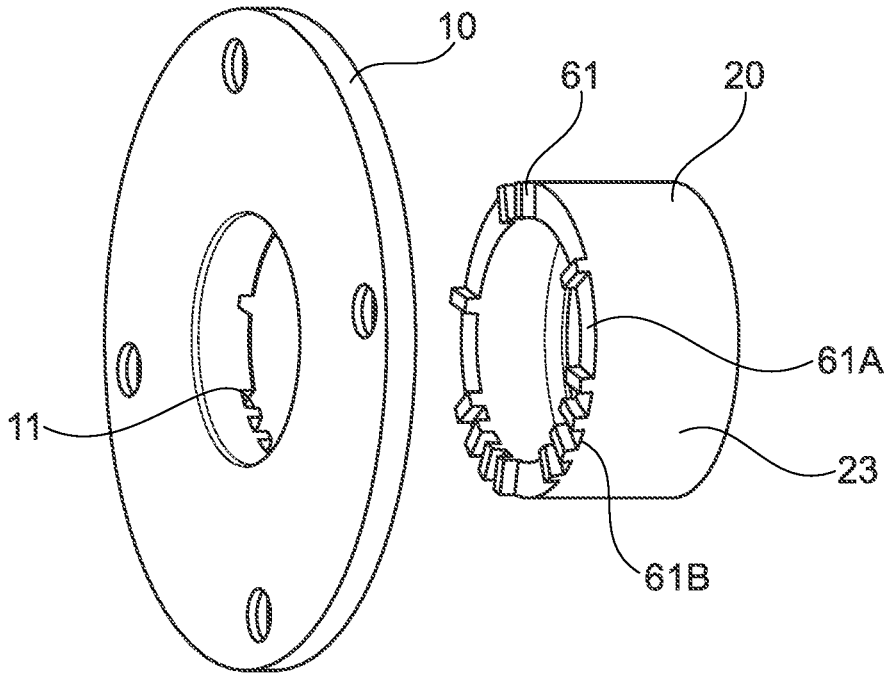
FIG. 4 is a front perspective view of the rear cover and outer camshaft of FIG. 2.
Figure 5:
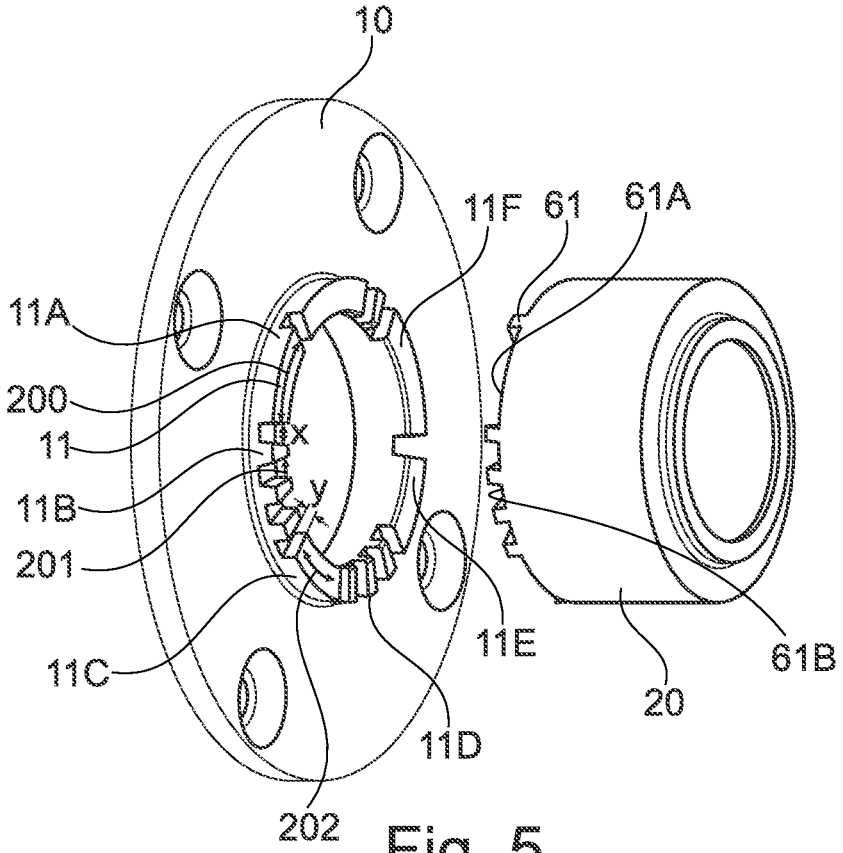
FIG. 5 is a rear perspective view of the rear cover and outer camshaft of FIG. 2.
Figure 6:
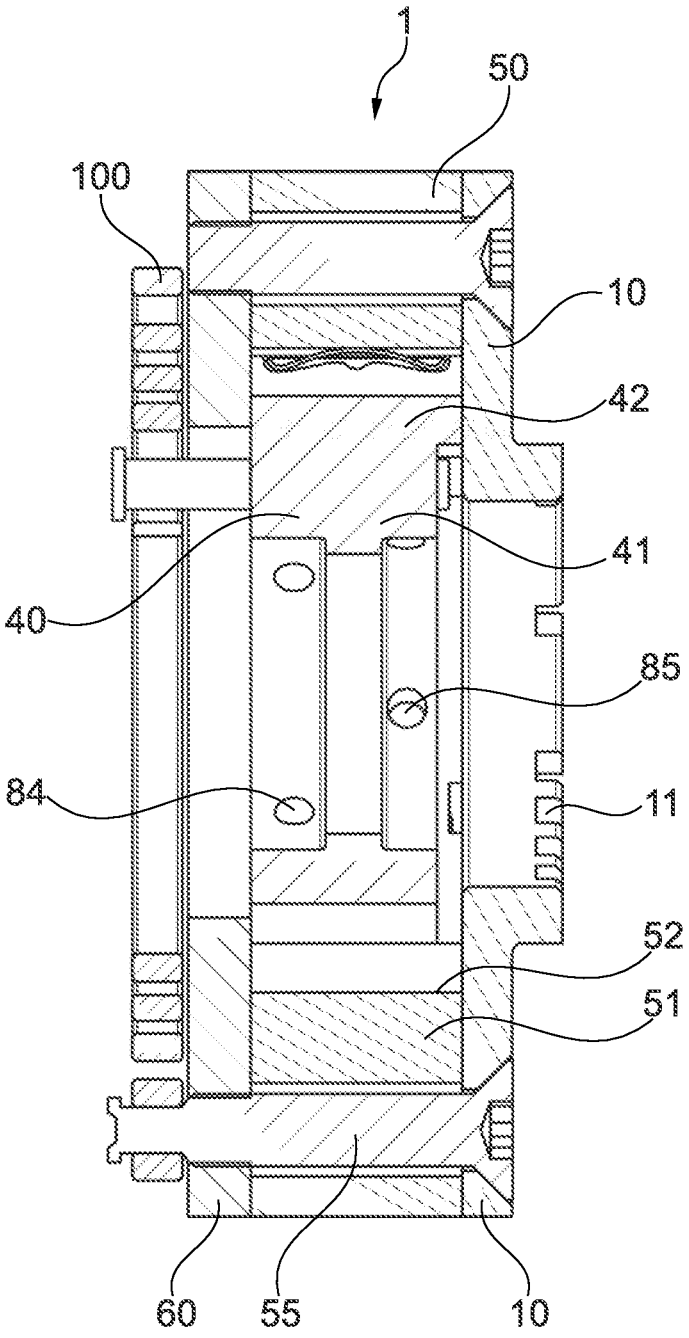
FIG. 6 is a cross sectional view of the camshaft phaser of FIG. 2.

FIG. 2 is a side view of a camshaft phaser assembly 1 and concentric camshaft assembly 2 according to one example embodiment. FIG. 3 is a cross-sectional view of camshaft phaser assembly 1 and concentric camshaft assembly 2 of FIG. 2 taken along line A-A. FIG. 4 is a front perspective view of rear cover 10 and outer camshaft 20 of FIG. 2. FIG. 5 is a rear perspective view of rear cover 10 and outer camshaft 20 of FIG. 2. FIG. 6 is a cross sectional view of camshaft phaser assembly 1 of FIG. 2. The following description should be viewed in light of FIGS. 2-6.

Camshaft phaser assembly 1 for concentric camshaft assembly 2 is shown. The concentric camshaft assembly 2, which is shown in most detail in FIG. 3, includes the inner camshaft 21 having a front end 22, with a central bolt receiving hole 16 oil feed passages 18. Outer camshaft 20, concentric with inner camshaft 21 is shown as having a first or front end 23 and a second end or main body 24, however, it will be understood by one skilled in the art that first end 23 and second end 24 may be formed as one component. Those skilled in the art will understand that both the inner and outer camshafts include cam lobes, with the cam lobes of the inner camshaft protruding through openings in the outer tubular camshaft. One of the inner camshaft or the outer camshaft is used to control the opening of the intake valves of an internal combustion engine, and the other is used to control the opening of the exhaust valves.

Camshaft phaser assembly 1 adjusts the relative rotational position of inner camshaft 21 relative to outer camshaft 20 and a crankshaft (not shown) of an internal combustion engine (not shown). As shown in detail in FIGS. 3 and 6, the camshaft phaser 1 includes rotor 40 having radially outwardly directed vanes 41. The rotor 30 is located radially inside stator 50 which includes radially inwardly directed projections 51. These projections 51 include bearing surfaces 52 which slidingly engage the outer surface of the rotor 40 at positions between the vanes 41. The vanes 41 extend into working spaces 42 defined between the projections 51 to divide the working spaces 42 into a first set of chambers 44 and a second set of chambers 46. The front and rear walls of these chambers are defined by a front cover 60 and a rear cover 10. The front and rear covers 60, 10 are connected to the stator 50 via bolts 55. Timing or drive gear 30 is connected to, for example by press fit, an outer radial surface of outer camshaft first end 23. Torque and rotational motion is transferred from the crankshaft (not shown) of the associated internal combustion engine (not shown) to timing gear 30 using a chain, to outer camshaft first end 23, into camshaft phaser assembly 1 and ultimately into inner camshaft 21. Alternatively, instead of a timing gear 30, a timing belt pulley could also be provided or any other suitable drive could be utilized for transferring the rotating motion of the crankshaft to the camshaft phaser 1. The timing gear 30 could alternatively be formed on or connected to the front or rear covers 60, 10 or to stator 50.

Camshaft phaser assembly 1 is oriented on concentric camshaft assembly 2 and torque and rotational movement are transferred between outer camshaft 20 and camshaft phaser assembly 1 by mating or meshing projections 11 on rear cover 10 with indentations 61 in outer camshaft 20. One of ordinary skill in the art will understand that projections in outer camshaft 20 can also mesh with indentations in rear cover 10. More specifically, rear cover 10 includes first protrusion 11A with first width 200 extending in a first axial direction separated from second protrusion 11B with second width 201 extending in the first axial direction. First protrusion 11A and second protrusion 11B are separated by a first circumferential distance x. Circumferential distances are defined as the distance between adjacent axially extending end walls of adjacent protrusions. Third protrusion 11C with third width 202 extending in the first axial direction is separated from the second protrusion 11B by a second circumferential distance y. In a first embodiment first width 200, second width 201 and third width 202 are different. In a second embodiment, first circumferential distance x and second circumferential distance y are different. In a third embodiment, first width 200, second width 201 and third width 202 are different and first circumferential distance x and second circumferential distance y are different. As shown in FIGS. 4 and 5, second protrusion 11B is a group of protrusions separated by equal circumferential distances. Any number of protrusions within such a group of protrusions are contemplated by this disclosure, as possible within particular applications and geometric restrictions. Furthermore, multiple further sets of protrusions are contemplated, as shown for example in FIGS. 4 and 5, fourth protrusion 11D, fifth protrusion 11E and sixth protrusion 11F.

Protrusions 11 align and mesh with indentations 61 of outer camshaft 20 in only one specific orientation. In the embodiment shown, for example, first protrusion 11A aligns and meshes with indentation 61A and second protrusion 11B aligns and meshes with indentations 61B. In this manner, rear cover 10 and camshaft phaser assembly 1 is oriented and assembled with concentric camshaft assembly 2 in a desired orientation. By using protrusions 11 and indentations 61 to orient camshaft phaser assembly 1 with concentric camshaft assembly 2, other orientation features, such as pins, may be eliminated.

Rotor 40 is then connected to the inner camshaft 21 via central bolt assembly 80 which clamps the rotor 40 to the inner camshaft 21. Central bolt assembly 80 includes a valve assembly 81 for directing pressurized hydraulic fluid to the first set of chambers 44 for rotating the rotor 40 in an advancing direction relative to the stator 50 in order to advance the timing of the inner camshaft 21, or to the second set of chambers 46 in order to rotate the rotor 40 in a direction to retard the timing of the inner camshaft 21. Hydraulic fluid can be applied to both the first and second sets of chambers 44, 46 in order to hydraulically lock the rotor 40 in a generally fixed position relative to the stator 50. An electromagnetic solenoid (not shown) is used in order to adjust the position of the valve spool 82 to direct pressurized hydraulic fluid to the passages 84, 85 as required. The valve spool 82 is biased to an initial position via a spring 86 which rests on a shoulder within the central bolt assembly 80. Pressurized hydraulic fluid is provided to the central bolt assembly 80 via pressurized hydraulic fluid being delivered through the inner camshaft 21. This travels past a check valve 87 and through a filter 88 of the central bolt assembly 80 prior to reaching the valve spool 82 which directs the pressurized hydraulic fluid to the passages 84,85 or to a drain back to the engine oil reservoir.

A helical spring 100 acts between the stator 50, via at least two of the assembly bolts 55 that engage the spring 100, and the rotor 40, via front cover 60. The spring 100 rotates the rotor 40 to a selected base position.

The camshaft phaser 1 is preassembled as a unit that can be installed in one piece on the front end of the concentric camshaft assembly 2 by aligning protrusions 11 with indentations 61, more particularly, by aligning for example first protrusion 11A with mating indentation 61A, second protrusion 11B with second indentation 61B and so on. The central bolt assembly 80 is then used to clamp the rotor 40 to the inner camshaft 21 and holds the entire phaser 1 in position axially on the front end of the concentric camshaft assembly 2.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A camshaft phaser assembly for a concentric camshaft that adjusts the relative rotational position of an inner camshaft relative to an outer camshaft and a crankshaft of an internal combustion engine, the phaser assembly comprising:

a rotor with radially outwardly extending vanes , the rotor arranged to connect to an inner camshaft;

a stator having radially inwardly directed projections which contact a radially outer surface of the rotor and form working spaces into which the vanes extend, the vanes dividing the working spaces into first and second sets of pressure chambers which can be pressurized with a hydraulic medium in order to rotate the rotor in an advancing or retarding direction;

a front cover connected to a front side of the stator defining a front side of the pressure chambers; and a rear cover connected to a rear side of the stator defining a rear side of the pressure chambers, the rear cover including:

a first protrusion with a first width extending in a first axial direction separated from a second protrusion with a second width extending in the first axial direction by a first circumferential distance; and, a third protrusion with a third width extending in the first axial direction separated from the second protrusion by a second circumferential distance;

wherein:

the first, second and third protrusions are arranged to engage respective indentations on an outer camshaft; and the first circumferential distance and the second circumferential distance are different.

2. The camshaft phaser assembly of claim 1, wherein at least one of the first protrusion, the second protrusion and the third protrusion is a group of axial protrusions separated by equal circumferential distances.

3. The camshaft phaser assembly of claim 1, wherein the first protrusion is arranged to engage with only one specific indentation on the outer camshaft.

4. The camshaft phaser assembly of claim 1, wherein the first width and the second width are different.

5. The camshaft phaser assembly of claim 1, further comprising a fourth protrusion separated from the third protrusion by a third circumferential distance.

6. The camshaft phaser assembly of claim 5, wherein the third circumferential distance is different from the first and the second circumferential distances.

7. The camshaft phaser assembly of claim 1, wherein the rotor is arranged to connect to the inner camshaft with a central bolt assembly which includes a pressurized hydraulic fluid control valve.

8. The camshaft phaser assembly of claim 7, wherein a hydraulic fluid filter is located in the central bolt assembly.

9. The camshaft phaser assembly of claim 1, further comprising a balance spring connected between the rotor and the stator that equalizes advancing and retarding adjustment forces.

10. The camshaft phaser assembly of claim 9, wherein the balance spring is connected to the stator by at least one of a plurality of axially extending assembly bolts that connect the front and rear covers to the stator.

11. A camshaft phaser assembly for a concentric camshaft that adjusts the relative rotational position of an inner camshaft relative to an outer camshaft and a crankshaft of an internal combustion engine, the phaser assembly comprising:

a rotor with radially outwardly extending vanes, the rotor arranged to connect to an inner camshaft;

a stator having radially inwardly directed projections which contact a radially outer surface of the rotor and form working spaces into which the vanes extend, the vanes dividing the working spaces into first and second sets of pressure chambers which can be pressurized with a hydraulic medium in order to rotate the rotor in an advancing or retarding direction;

a front cover connected to a front side of the stator defining a front side of the pressure chambers; and a rear cover connected to a rear side of the stator defining a rear side of the pressure chambers, the rear cover including:

a first protrusion with a first width extending in a first axial direction separated from a second protrusion with a second width extending in the first axial direction by a first circumferential distance; and, a third protrusion with a third width extending in the first axial direction separated from the second protrusion by a second circumferential distance;

wherein:

the first, second and third protrusions are arranged to engage respective indentations on an outer camshaft;

the first width and the second width are different; and, the first circumferential distance and the second circumferential distance are different.

12. The camshaft phaser assembly of claim 11, wherein at least one of the first protrusion, the second protrusion and the third protrusion is a group of protrusions extending in the first axial direction separated by equal circumferential distances.

13. The camshaft phaser assembly of claim 11, wherein the first protrusion is arranged to engage with only one specific indentation on the outer camshaft.

14. The camshaft phaser assembly of claim 11, further comprising a fourth protrusion separated from the third protrusion by a third circumferential distance.

15. The camshaft phaser assembly of claim 14, wherein the third circumferential distance is different from the first and the second circumferential distances.

16. The camshaft phaser assembly of claim 11, wherein the rotor is arranged to connect to the inner camshaft with a central bolt assembly which includes a pressurized hydraulic fluid control valve.

17. The camshaft phaser assembly of claim 16, wherein a hydraulic fluid filter is located in the central bolt assembly.

18. The camshaft phaser assembly of claim 11, further comprising a balance spring connected between the rotor and the stator that equalizes advancing and retarding adjustment forces.

19. The camshaft phaser assembly of claim 18, wherein the balance spring is connected to the stator by at least one of a plurality of axially extending assembly bolts that connect the front and rear covers to the stator.

20. A camshaft phaser assembly for a concentric camshaft that adjusts the relative rotational position of an inner camshaft relative to an outer camshaft and a crankshaft of an internal combustion engine, the phaser assembly comprising:

a rotor with radially outwardly extending vanes , the rotor arranged to connect to an inner camshaft;

a stator having radially inwardly directed projections which contact a radially outer surface of the rotor and form working spaces into which the vanes extend, the vanes dividing the working spaces into first and second sets of pressure chambers which can be pressurized with a hydraulic medium in order to rotate the rotor in an advancing or retarding direction;

a front cover connected to a front side of the stator defining a front side of the pressure chambers; and a rear cover connected to a rear side of the stator defining a rear side of the pressure chambers, the rear cover including:

a first protrusion with a first width extending in a first axial direction separated from a second protrusion with a second width extending in the first axial direction by a first circumferential distance; and, a third protrusion with a third width extending in the first axial direction separated from the second protrusion by a second circumferential distance;

wherein:

the first, second and third protrusions are arranged to engage respective indentations on an outer camshaft;

the first width and the second width are different; and the first circumferential distance and the second circumferential distance are different.

* * * * *